US006837726B1

(12) United States Patent
Kiermaier

(10) Patent No.: US 6,837,726 B1
(45) Date of Patent: Jan. 4, 2005

(54) HOLDER FOR DISCHARGE LAMP

(75) Inventor: Ludwig P. Kiermaier, Edison, NJ (US)

(73) Assignee: E.G.L. Company, Inc., Berkeley Heights, NJ (US)

( * ) Notice: Subject to any disclaimer, the term of this patent is extended or adjusted under 35 U.S.C. 154(b) by 0 days.

(21) Appl. No.: 10/389,574

(22) Filed: Mar. 17, 2003

Related U.S. Application Data

(63) Continuation-in-part of application No. 09/935,109, filed on Aug. 23, 2001, now Pat. No. 6,666,700.

(51) Int. Cl.[7] ..... H01R 33/02; H01R 33/08

(52) U.S. Cl. ..... 439/235; 439/242; 174/50; 362/217

(58) Field of Search ..... 439/242–244, 439/226, 535–537, 419, 666–667, 682–683; 174/53–58; 362/217, 226, 362; 340/693.9

(56) References Cited

U.S. PATENT DOCUMENTS 5,189,259 A * 2/1993 Carson et al. ..... 174/66
5,370,546 A * 12/1994 Evanisko ..... 439/226
5,390,094 A * 2/1995 Evanisko ..... 362/267
5,562,341 A * 10/1996 Strauss ..... 362/226
5,603,627 A * 2/1997 Evanisko ..... 439/235
6,079,848 A * 6/2000 Ahroni ..... 362/249
6,099,336 A * 8/2000 Evanisko ..... 439/231
6,103,972 A * 8/2000 Hagarty ..... 174/53
6,162,096 A * 12/2000 Klaus ..... 439/617
6,190,191 B1 * 2/2001 Pasternak ..... 439/236
6,271,763 B1 * 8/2001 Hur ..... 340/693.12
6,322,232 B1 * 11/2001 Oliver ..... 362/147
6,369,322 B1 * 4/2002 Gretz ..... 174/50
6,423,897 B1 * 7/2002 Roesch et al. ..... 174/50

* cited by examiner

*Primary Examiner*—Michael C. Zarroli
(74) *Attorney, Agent, or Firm*—Thomas L. Adams

(57) ABSTRACT

A lamp holder that can receive a discharge lamp has an insulating body that can work with an electrically conductive junction box. The junction box has a bottom, an opening opposite the bottom, and one or more sidewalls circumscribing the opening. The insulating body is sized to fit at least partially into the box, and has a flange sized to surmount and circumscribe the sidewalls that circumscribe the opening. The insulating body has (a) a cavity with a lamp entryway, and (b) a wire passageway providing access into the cavity. The wire passageway may travel partly underneath the cavity, or through a portion of the wall having a relatively greater wall thickness (or may travel otherwise.) A lamp contact is mounted in the cavity for electrically engaging the discharge lamp.

30 Claims, 7 Drawing Sheets

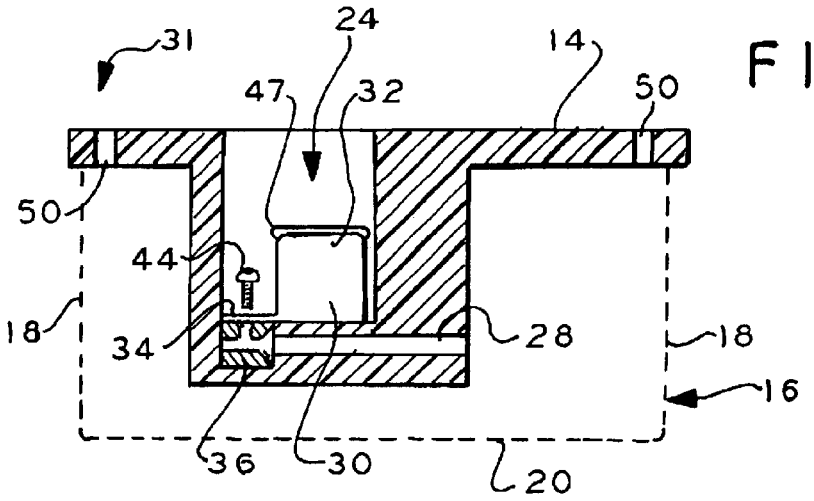
FIG. 2
FIG. 3
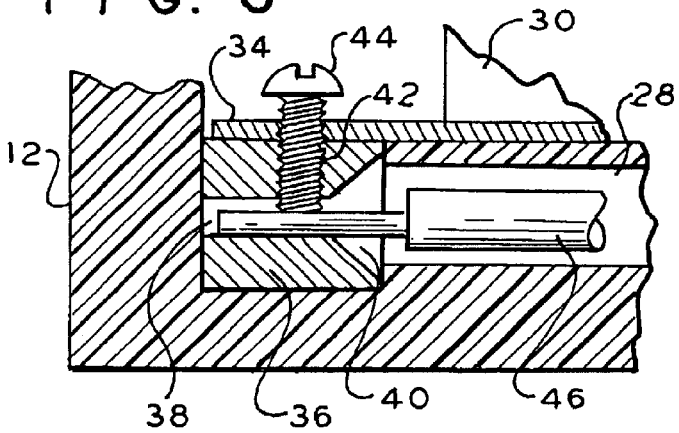
FIG. 5
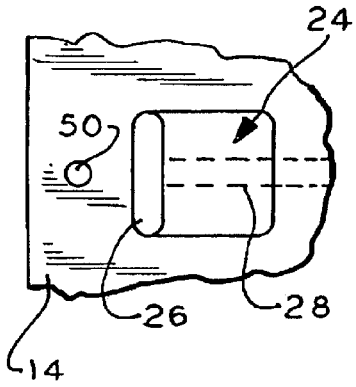
FIG. 4
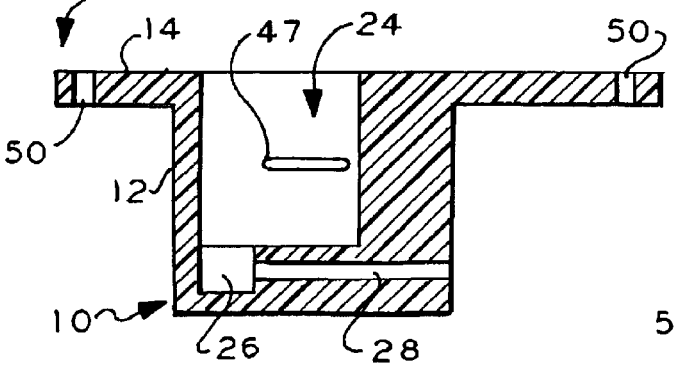
FIG. 6
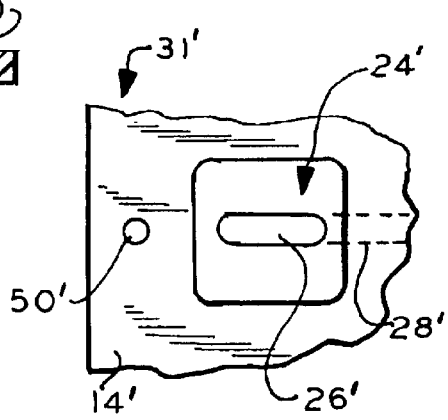

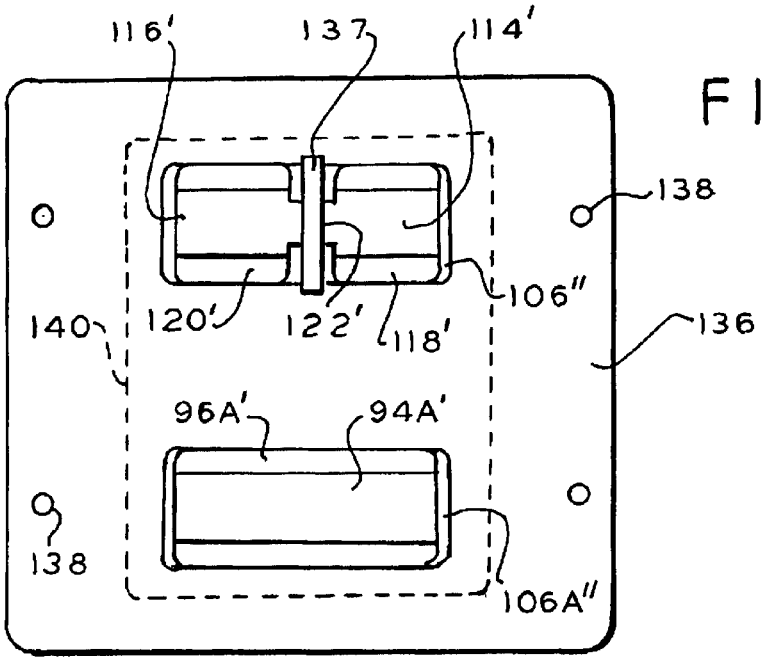
FIG. 17
FIG. 20
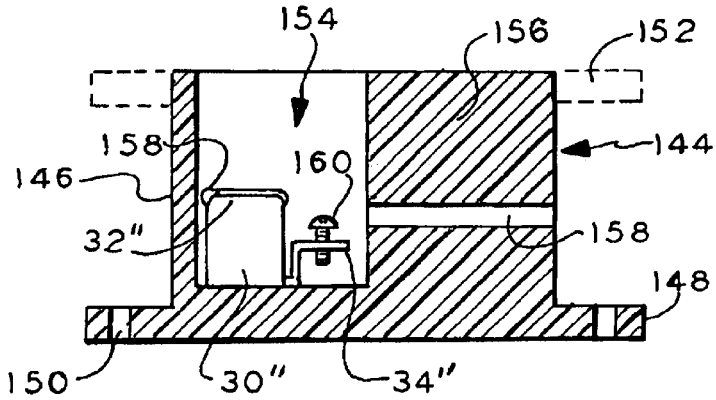
FIG. 18
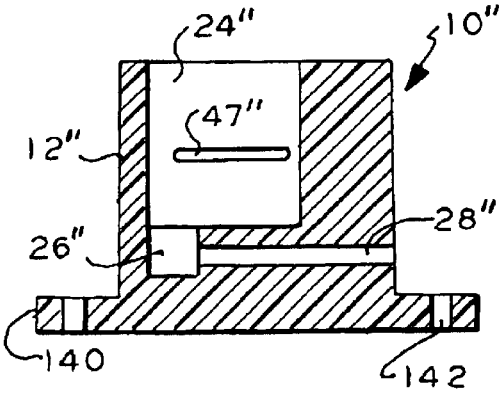
FIG. 19
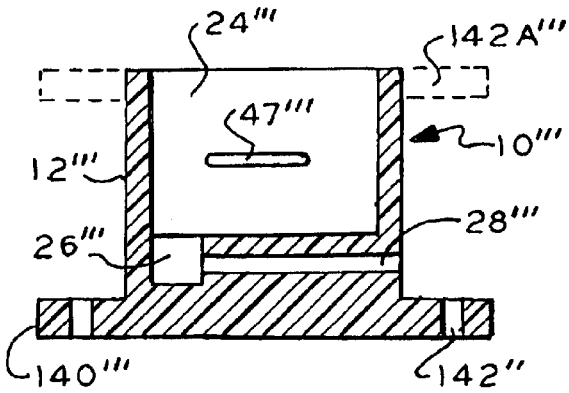

HOLDER FOR DISCHARGE LAMP

This is a continuation-in-part of U.S. patent application Ser. No. 09/935,109, filed Aug. 23, 2001 now U.S. Pat. No. 6,666,700.

BACKGROUND OF THE INVENTION

1. Field of the Invention

The present invention relates to lamp holders for discharge lamps, and in particular, to lamp holders arranged to deal with high voltage.

2. Description of Related Art

Known discharge lamps employ a glass tube containing an inert gas. An electrical potential applied to electrodes at either end of the tube causes a discharge current to flow through the tube. This discharge will produce radiation that may or may not be in the visible range. Commonly, a fluorescent coating will line the inside of the glass tube to convert the radiation into visible light. Examples of such discharge lamps are commonly known as fluorescent lamps or neon lights (although these neon lights do not necessarily contain neon gas). A large discharge lamp of the "neon" type is often referred to as a cold cathode lamp.

Discharge lamps will often operate with a relatively high voltage, for example 15 kV. Consequently, special precautions are implemented to avoid inappropriate arcing or corona discharge. For this reason, traditional lamp holders have been made of ceramic to take advantage ceramic's ability to sustain high temperature and voltages without breaking down. These traditional lamp holders have a cup-shaped body containing a U-shaped metal contact that can connect to an end cap of the discharge lamp.

Industry standards have specified criteria for routing high voltage wiring into a lamp holder. In general, it is desirable shield high voltage conductors from the environment. If a high voltage conductor must be exposed, however, the spacing through free air to ground ought to exceed a minimum established for the particular magnitude of voltage. UL 879 Standard for Electrode Receptacles for Gas-Tube Signs ($5^{th}$ edition-first impression, Aug. 14, 1981) specifies a spacing of 1½ inches for receptacles rated at 7,500 volts, which voltage is normally supplied with secondary wiring from a 15,000 volt transformer. See also, U.S. Pat. No. 2,406,145. col. 3, line 60 through col. 4, line 4.

In order to establish such spacing, traditional lamp holders have employed tubular, ceramic wire guideways to maintain this minimum spacing. See U.S. Pat. Nos. 2,208,812; 2,326,792; 2,375,807; 2,651,024; and 5,370,546.

Other commercial lamp holders have installed a traditional cup-shaped ceramic holder inside a metal junction box. A high voltage wire can then be routed through a flexible conduit that is attached in a conventional manner to an opening in the side of the junction box. Therefore, the high voltage wire and other high voltage components will be shielded by the flexible conduit and by the metal junction box. Any arcing or corona will be shunted to the junction box, which is typically grounded. These known ceramic holders protrude through the top of the junction box. Because the ceramic holders are not as wide as the junction box, gaps are reduced by placing atop the junction box a cover with a custom cutout designed to closely encircle the body of the ceramic holder. These designs have employed the traditional tubular ceramic spacer, but the spacer itself consumes significant space inside the junction box. For this reason, the ceramic spacer has been positioned to extend outside the box into a fitting attached to the side of the junction box.

A lamp holder disclosed in U.S. Pat. No. 5,603,627 also mounts a cup-shaped ceramic body inside a metal junction box, but eliminates the tubular ceramic spacer. Instead of a spacer, this arrangement seals the high voltage wires to a hole in the ceramic body with a silicon caulk. This holder, while fitting more easily into a metal junction box, sacrifices the shielding effect offered by the spacer. In any event, these known arrangements require the installer to keep a supply of custom covers.

See also U.S. Pat. Nos. 602,966; 1,875,179; 2,045,229; 2,620,372; 2,644,027; 3,753,027; and 5,390,094;

Accordingly, there is a need for a lamp holder with an insulating body that can shield high voltage components and still, if desired, fit easily and simply into a metal junction box.

SUMMARY OF THE INVENTION

In accordance with the illustrative embodiments demonstrating features and advantages of the present invention, there is provided a lamp holder for receiving a discharge lamp. The lamp holder includes an electrically conductive box having a bottom, an opening opposite the bottom, and one or more sidewalls circumscribing the opening. The lamp holder also includes an insulating body sized to fit at least partially into the box. This insulating body has a flange sized to surmount and circumscribe the one or more sidewalls that circumscribe the opening. The insulating body has (a) a cavity with a lamp entryway, and (b) a wire passageway providing access into the cavity. Also included is a lamp contact mounted in the cavity for electrically engaging the discharge lamp.

In accordance with another aspect of the invention, the foregoing lamp holder is provided as described without the above mentioned wire passageway.

In accordance with yet another aspect of the invention, a lamp holder is adapted to fit at least partially into a standard metal junction box. The junction box has a bottom, an opening opposite the bottom, and one or more sidewalls circumscribing the opening. The lamp holder includes an insulating body sized to fit at least partially into the box. This insulating body has a flange sized to surmount and circumscribe the one or more sidewalls that circumscribe the opening. The insulating body has (a) a cavity with a lamp entryway, and (b) a wire passageway providing access into the cavity. Also included is a lamp contact mounted in the cavity for electrically engaging the discharge lamp.

In accordance with still another aspect of the invention, a lamp holder is provided for receiving a discharge lamp. The lamp holder includes an insulating body having (a) a cavity with a lamp entryway, and (b) a wire passageway formed in the insulating body and partly traveling underneath the cavity for providing access into the cavity. Also included is a lamp contact mounted in the cavity for electrically engaging the discharge lamp.

In accordance with still yet another aspect of the invention, a lamp holder is provided for receiving a discharge lamp. The lamp holder comprises an insulating body having a base, and one or more walls emerging from the base to circumscribe a cavity that is open through a lamp entryway. This insulating body has formed therein a wire passageway passing through a portion of the wall having a wall thickness greater than that existing across the cavity opposite the passageway. Also included is a lamp contact mounted in the cavity for electrically engaging the discharge lamp.

By employing equipment of the foregoing type, an improved lamp holder is achieved. In a preferred embodiment, a cup-shaped ceramic body has a flange with an outline large enough to circumscribe the sidewalls of a metal junction box. Therefore, this preferred ceramic body can be attached to the opening of the metal junction box without the need for a cover plate. In highly preferred embodiments, the flange of the ceramic body will be designed to fit directly over the opening of a standard electrical junction box. Therefore, the installer need not obtain and stock non-standard junction boxes. Thus, the same junction box can be used for the high and lower voltage wiring. Also, the flange will be sized to completely cover the opening of the junction box so that a cover plate is unnecessary.

A preferred ceramic body will have a wire passageway that is relatively long so that internal high voltage components will be shielded. Instead of using a space-consuming ceramic sleeve, a wire passageway will follow a relatively long path through the ceramic body. In one embodiment, a wire passageway will pass through the base of the ceramic body underneath a cavity containing the lamp contact, before emerging into the cavity. In another embodiment, the wire passageway will pass through a sidewall at a location where the wall is relatively thick. These arrangements will effectively shield high voltage components inside the ceramic body.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 2 is an elevational view, partly in longitudinal section, of the lamp holder of FIG. 1;

FIG. 3 is a detailed view of the lower left corner of the lamp holder of FIG. 2;

FIG. 4 is a longitudinal sectional view of the insulating body of FIG. 2 with its internal components removed;

FIG. 5 is a detailed, fragmentary, top view of the insulating body of FIG. 1;

FIG. 6 is a detailed, fragmentary, top view of an insulating body that is an alternate to that of FIG. 1;

FIG. 17 is a top view of a lamp holder that is an alternate to that of FIG. 15, with two cavities, each designed to hold two lamps;

FIG. 18 is a sectional, elevational view of an alternate insulating body with a lower flange;

FIG. 19 is a sectional, elevational view of an insulating body for a lamp holder that is an alternate to that of FIG. 18;

FIG. 20 is a sectional, elevational view of an alternate lamp holder;

DETAILED DESCRIPTION OF THE PREFERRED EMBODIMENTS

Figure 1:
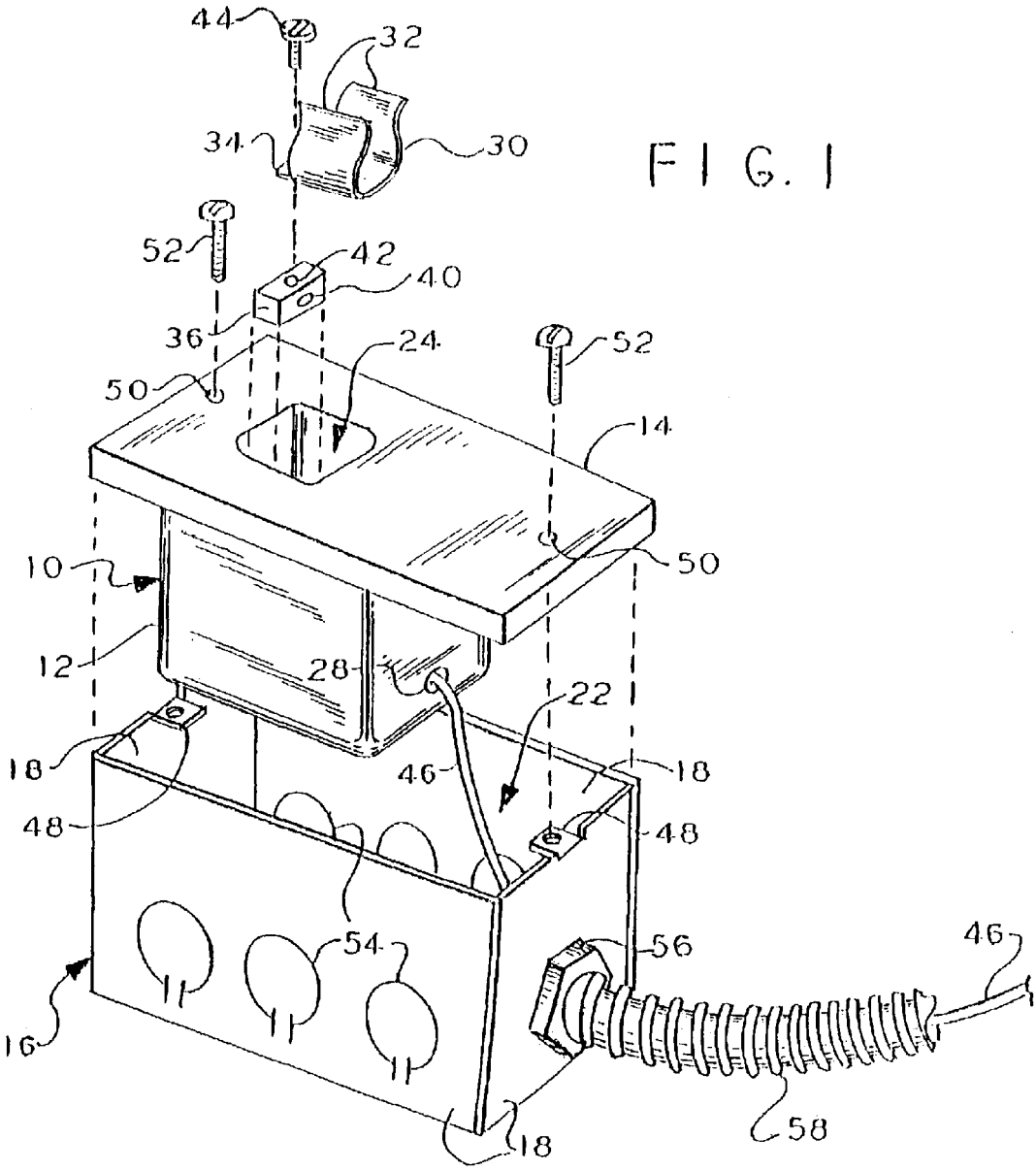
FIG. 1 is an exploded, perspective view a lamp holder in accordance with principles of the present invention.

Referring to FIGS. 1–5, a lamp holder is shown as an insulating body 10 having a cup-shaped receptacle 12 depending from a flange 14. Body 10 may be molded ceramic, but other embodiments may employ phenolic, plastic, or other synthetic or natural materials. Preferably, body 10 will have good electrical insulating properties and high thermal stability. While body 10 is shown herein as an integral molded unit, other embodiments may be made of multiple components that are secured with cement, fasteners, or otherwise. In still other embodiments these various components may be made of different materials and maybe shaped by molding, machining, etc.

In this preferred embodiment flange 14 has a generally rectangular outline (although the corners can be somewhat rounded in some embodiments) and therefore has two pairs of opposite parallel edges. As described further hereinafter, flange 14 is designed to be secured to a metal junction box 16.

Junction box 16 is an electrically conductive box having four sidewalls 18, a bottom 20 and an opening 22 (box shown in phantom in FIG. 2). For embodiments employing a standard electrical junction box, box 16 will be 4 inches (10 cm) long, 2⅛ inches (5.4 cm) wide, and 2⅛ inches (5.4 cm) high. It will be appreciated, however, that junction boxes have a variety of standard sizes. In some instances the junction box will have a generally cylindrical shape, in which case the box may be deemed to have only one sidewall, and one bottom.

Illustrated flange 14 is 4½ inches long and 2¼ inches wide (11.4 cm by 5.7 cm) and 5/16 inch thick (0.8 cm), although other dimensions may be employed depending upon the associated junction box, the desired degree of overlap, the desired strength, the material used in the flange, etc. It is preferable to make the length and width of flange 14 slightly greater than the length and width of junction box 16, so that flange 14 will surmount and circumscribe sidewalls 18 of junction box 16. The flange 14 is deemed to circumscribe the sidewalls 18 if the outline of the sidewalls 18 will fit inside (or will be partly or fully contiguous with) the outline of flange 14, when viewed from an overhead or plan view. It is desirable to have the flange circumscribe the junction box in this fashion also when the box is cylindrical and therefore has only one sidewall to circumscribe.

Insulating body 10 has a cavity 24 serving as a lamp socket. Cavity 24 Cavity 24 is bounded on the side by encompassing walls and opens on the flange side to provide a lamp entryway. Cavity 24 is substantially rectangular with rounded corners, although in other embodiments the opening may be circular, D-shaped, etc. The base of cavity 24 has a rectangular recess or well 26. Well 26 may be formed by molding, milling, or otherwise. A longitudinally disposed wire passageway 28 extends from an exit portal in well 26 to an entrance portal on the outside of receptacle 12, traveling partly underneath cavity 24. By taking this path, passageway 28 is relatively long (in comparison, for example, to a passageway traveling in the opposite direction through the relatively thin opposite wall of well 26). In this embodiment, passageway 28 is approximately 1½ inches (3.8 cm) long.

Also in this embodiment, the cup-shaped receptacle 12 is positioned non-symmetrically. Specifically, receptacle 12 is offcentered to the left in the views of FIGS. 1–4. This shifting to the left is herein referred to as a bias to a predetermined side 31. In this regard, cavity 24 is shown to be encompassed by a non-symmetrical wall thickness, with a thinner wall thickness towards predetermined side 31 and a greater wall thickness in the opposite direction.

A lamp contact is shown herein as a U-shaped clip 30 with outwardly flared tips 32. The floor of clip 30 extends outwardly into perforated tab 34, which is welded or otherwise secured to block 36. Block 36 has a wire channel 38 that flares into a funnel-shaped mouth 40. Transverse to channel 38 is a threaded hole 42, into which a wire-securing screw 44 is threaded. As shown in FIG. 3, the stripped end of wire 46 is fed through the funnel-shaped mouth 40 into the wire channel 38. Screw 44 is tightened onto the end of wire 46 to hold it in place inside block 36. Accordingly, electrical continuity exists from wire 46 to clip 30.

A pair of grooves 47 are formed on opposite walls inside cavity 24. Grooves 47 are designed to capture the flared tips 32 and hold clip 30 in place.

Junction box 16 has on the upper edge of an opposite pair of sidewalls 18, an integral pair of landings 48. Landings 48 are essentially tabs formed in the upper edge of sidewalls 18 and bent over at a right angle with the sidewall. Screw holes 50 and flange 14 align with the threaded holes in landings 48. Accordingly, flange 14 can be secured to box 16 by means of screws 52, which pass through holes 50 and thread into the holes of landings 48.

Junction box 16 is shown with a number of conventional knockout disks 54, which can be removed to create an opening or portal in the sidewalls 18. Attached to one such portal is a fitting 56 which secures a flexible conduit 58 to the sidewall 18. Accordingly, high voltage wire 46 can be routed through flexible conduit 58 and fitting 56 into the interior of junction box 16 before being fed into wire passageway 28 as shown. This wiring arrangement brings secondary voltage to one end of a lamp (or a string of lamps). A lamp holder operating in this fashion is sometimes referred to as a terminal socket.

Figure 7:
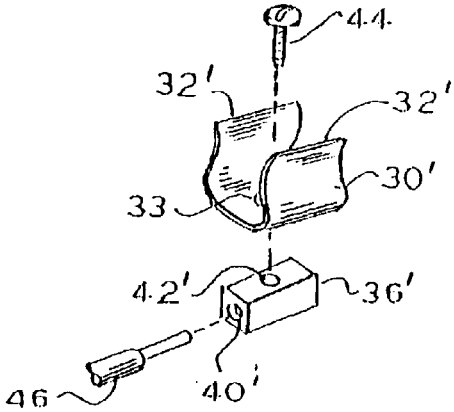
FIG. 7 is an exploded view of a lamp contact designed to be mounted in the insulating body of FIG. 6.

Referring to FIGS. 6 and 7, components similar or relating to components in FIGS. 1 and 5 bear the same reference numeral but marked with a prime (′). In this embodiment, alternate clip 30′ lacks an extension (such as tab 34 of FIG. 1). Instead, the underside of clip 30′ is welded to the top of block 36′ with the aperture 33 aligned with threaded hole 42′. Formed on an end of block 36′ is a funnel shaped mouth 40′ leading to a wire channel that intersects with hole 42′. Therefore, screw 44 can be threaded through aperture 33 into hole 42′ to secure wire 46. As before, tips 32; can snap into mating grooves in cavity 24′.

Cavity 24′ has a centrally located well 26′ that is aligned toward the predetermined side 31′. Wire passageway 28′ intersects and communicates with well 26′ and travels away from the well and side 31′.

Figure 9:
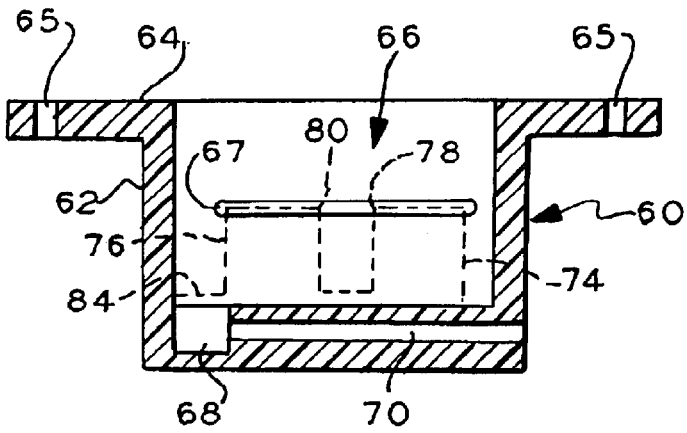
FIG. 9 is sectional view of the dual-lamp holder, taken along line 9—9 of FIG. 8.
Figure 8:
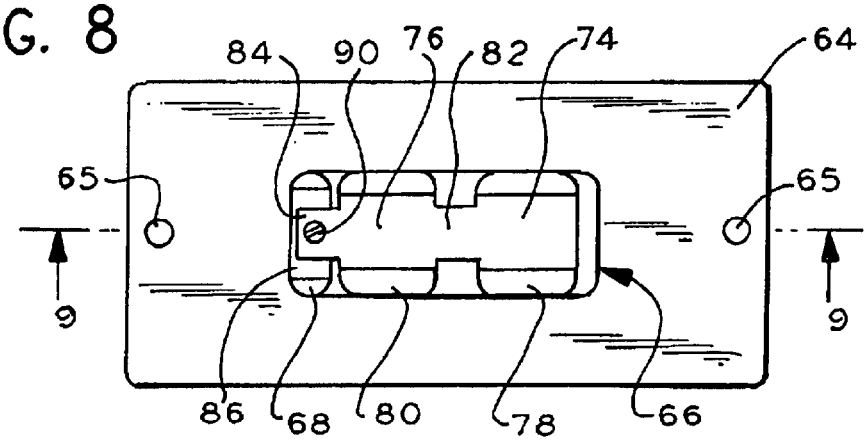
FIG. 8 is a top view of a dual-lamp holder that is an alternate to that of FIG. 1.
Figure 10:
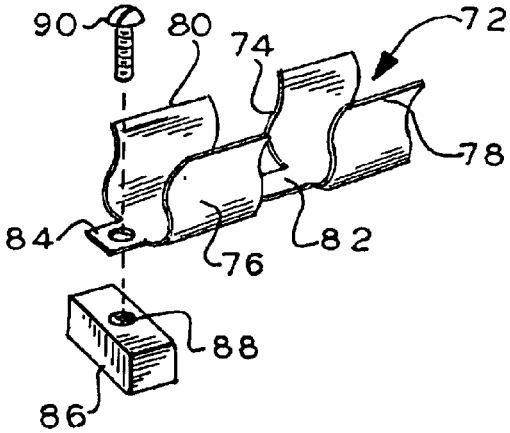
FIG. 10 is an exploded, perspective view of the lamp contact of FIG. 8.

Referring to FIGS. 8–10, an alternate lamp holder is shown as an insulating body 60 having a cup-shaped receptacle 62 depending from a flange 64, which has screw holes 65 and a generally rectangular outline (although the corners can be somewhat rounded in some embodiments). Insulating body 60 has a cavity 66 bounded on the side by encompassing walls and serving as a lamp socket. Cavity 66 opens on the flange side to serve as a lamp entryway. The base of cavity 66 has a rectangular recess or well 68. A longitudinally disposed wire passageway 70 extends from an exit portal in well 68 to an entrance portal on the outside of receptacle 62, traveling partly underneath cavity 66. By taking this path, passageway 28 is relatively long.

A lamp contact is shown herein as a metal stamping 72 having a pair of U-shaped clips 74 and 76 with outwardly flared tips 78 and 80, respectively. The floors of clips 74 and 76 are connected through integral bridge 82. The floor of clip 76 extends outwardly into perforated tab 84, which is welded to block 86. Block 86 has a threaded hole 88, which is transverse to a wire channel (not shown) with a flared mouth. A wire-securing screw 90 can be threaded through tab 84 into hole 88 to hold a wire in place inside block 86 in a fashion similar to that shown in FIG. 3.

A pair of grooves 67 are formed on opposite walls inside cavity 66. Grooves 67 are designed to capture the flared tips 78 and 80 to hold clips 74 and 76 in place. As before, high voltage wire can be routed through wire passageway 70 into well 68. Thereafter, screw 90 can be threaded into hole 88 to hold a high voltage wire in block 86.

Figure 11:
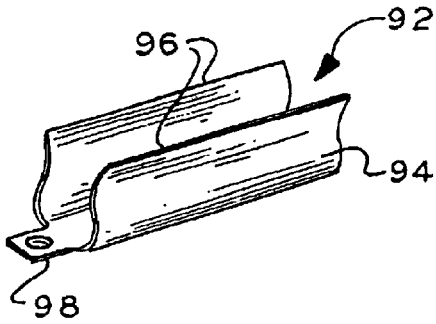
FIG. 11 is a perspective view of a lamp contact that is an alternate to that of FIG. 10.

While the stamping 72 of FIG. 10 is shown with two distinct clips 76 and 78, a larger continuous clip 92 may be used as shown in FIG. 11. There a single U-shaped clip 94 is in the form of a channel with flared tips 96. As before, the floor of the clip is extended into a perforated tab 98.

In any event, cavity 66 (FIG. 9) provides a lamp entryway for the insertion of the ends of two separate lamps (not shown). One lamp may be inserted into clip 74, while the other lamp is inserted into clip 76. These lamps will in effect be connected together because of the continuity from clip 74 to clip 76. In some instances this connection will have the two lamps operating in series. In other cases a high voltage wire will bring a supply potential through passageway 70 to clips 74 and 76 so that the two lamps will operate in parallel.

Figure 13:
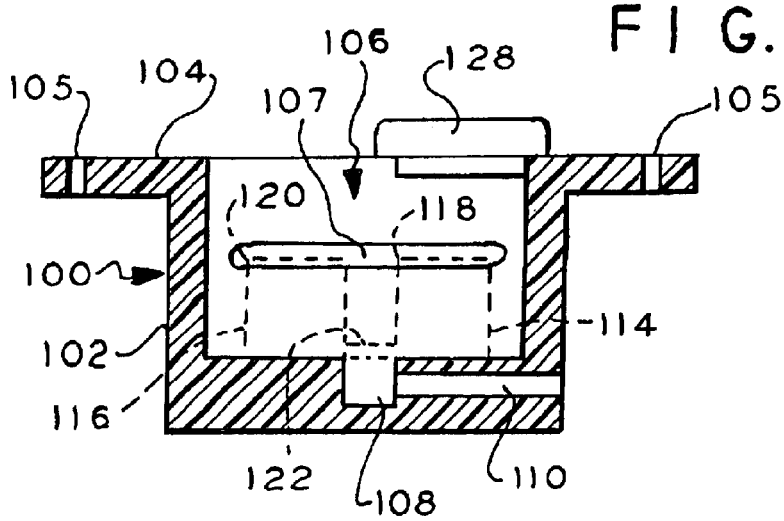
FIG. 13 is a sectional view of the holder taken along line 13—13 of FIG. 12.
Figure 12:
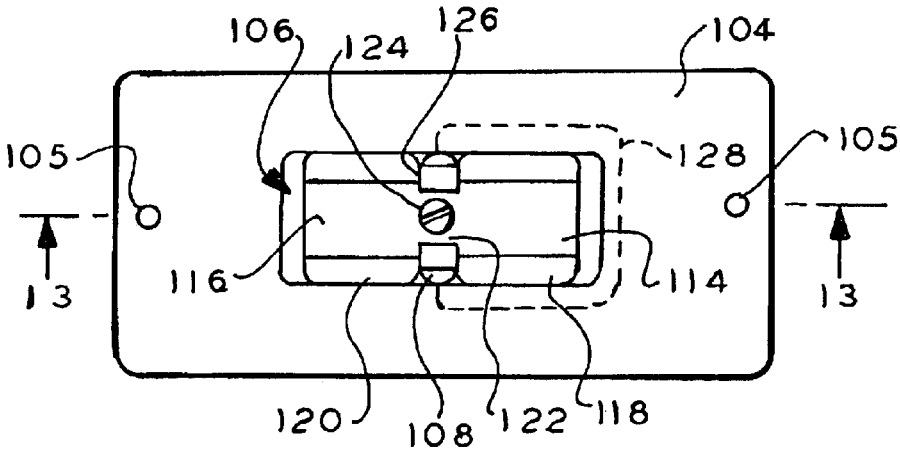
FIG. 12 is a top view of a lamp holder that is an alternate to that of FIG. 8.

Referring to FIGS. 12 and 13, an alternate lamp holder is shown as an insulating body 100 having a cup-shaped receptacle 102 depending from a flange 104, which has screw holes 105 and a generally rectangular outline. Insulating body 100 has a cavity 106 serving as a lamp socket. Cavity 106 opens on the flange side to serve as a lamp entryway. Centered in the base of cavity 106 is a rectangular recess or well 108. A longitudinally disposed wire passageway 110 extends from well 108 to the outside of receptacle 102, traveling partly underneath cavity 106.

A lamp contact is shown herein as a metal stamping having a pair of U-shaped clips 114 and 116 with outwardly flared lips 118 and 120, respectively. The floors of clips 114 and 116 are connected through integral bridge 122, which is perforated and welded to block 126. This clip is similar to that shown in FIG. 10 (except that tab 84 is eliminated and bridge 82 is perforated). Block 126 has a threaded hole (similar to FIG. 10), which is transverse to a wire channel (not shown) with a flared mouth. A wire-securing screw 124 can be threaded through bridge 122 into block 126 to hold a wire in place in a fashion similar to that shown in FIG. 3.

A pair of grooves 107 are formed on opposite walls inside cavity 106. Grooves 107 are designed to capture the flared tips 118 and 120 to hold clips 114 and 116 in place. As before, high voltage wire can be routed through wire passageway 110 into well 108. Thereafter, screw 124 can be tightened to hold a high voltage wire in block 126.

As before, the capped ends of a pair of lamps can be pushed into clips 114 and 116. Depending upon any wiring present in passageway 110 these lamps can be operated either in series or parallel.

While receptacle 102 has the capacity to accept two lamps, cavity 106 is shown partially covered with ceramic cap 128 so that only one lamp can be accepted in cavity 106. Cap 128 may be glued in place, or in other embodiments, a threaded stud (not shown) may be attached to clip 114 and cap 128 can be attached to that threaded stud. An advantage of this arrangement is that an installer need only stock a single body 100, and this body can be adapted to deal with either single or dual lamp configurations.

Figure 14:
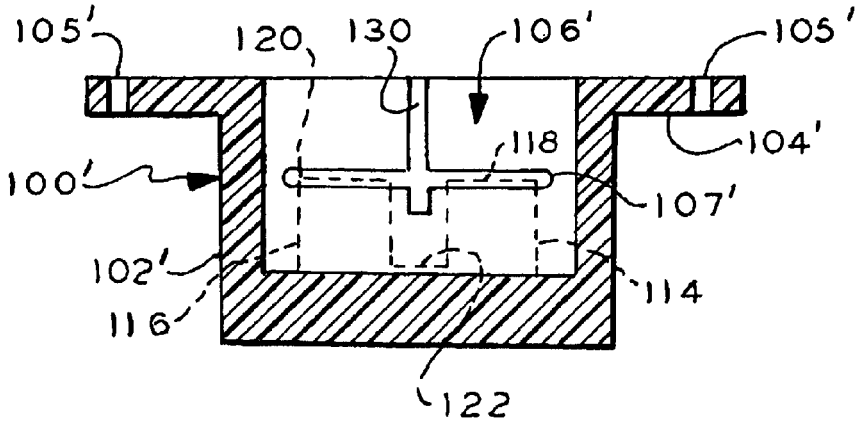
FIG. 14 is a sectional view of an insulating body without a wire passageway that is an alternate to that shown in FIG. 13.

Referring to FIG. 14, components similar or relating to components in FIG. 13 bear the same reference numeral but marked with a prime (′). In this embodiment, an alternate lamp holder is shown as an insulating body 100′ having a cup-shaped receptacle 102′ depending from a flange 104′, which has screw holes 105′ and a generally rectangular outline. Insulating body 100′ has a cavity 106′ serving as a lamp socket. A lamp contact identical to that shown in FIG. 13 has clips 114 and 116 connected through integral bridge 122. (Unlike FIG. 13, bridge 122 is not connected to a block.) A pair of grooves 107′ formed on opposite walls inside cavity 106′ are designed to capture the flared tips 118 and 120 to hold clips 114 and 116 in place.

Body 100′ does not have a wire passageway as shown in the other embodiments. Therefore, this lamp holder can be used to accept the ends of two separate lamps and connect them in series.

Another pair of grooves 130 are formed on opposing faces inside cavity 106′. Grooves 130 are designed to hold a dividing wall (shown hereinafter). Such a dividing wall can be inserted from above into the grooves 130 to divide cavity 106′ into two separate compartments, one served by clip 114, and the other served by clip 116. Such a dividing wall can help guide the lamp ends and position them properly onto their respective clips 114 and 116.

Figure 15:
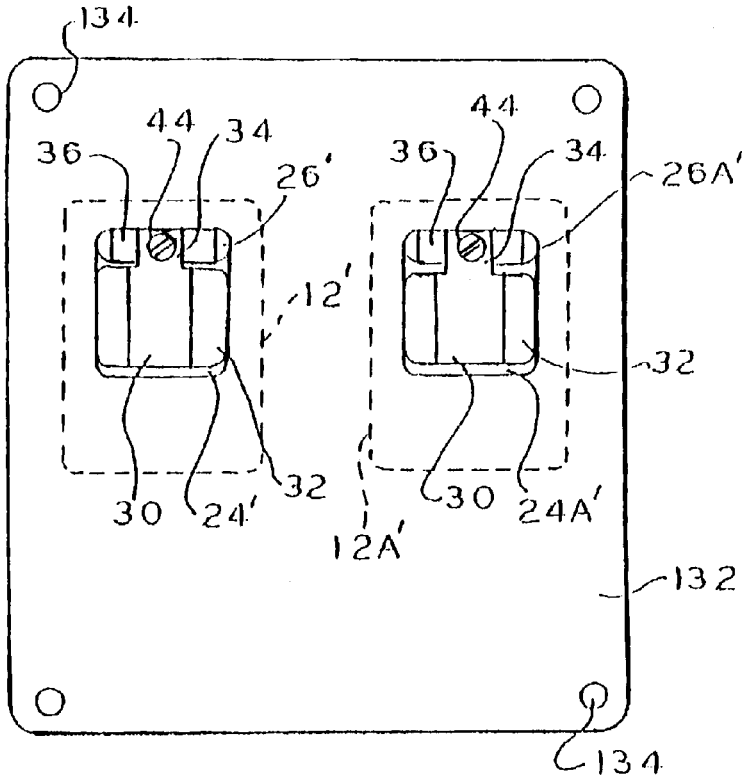
FIG. 15 is a top view of an alternate lamp holder having dual cavities and designed for a larger junction box.
Figure 16:
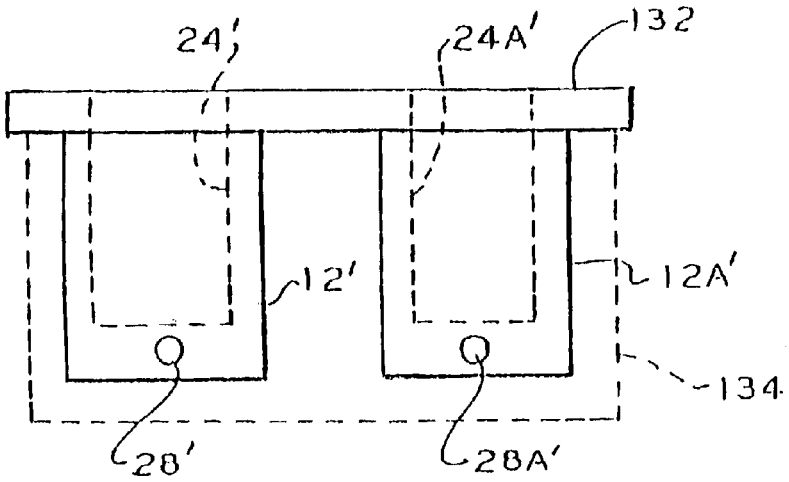
FIG. 16 is an elevational view of the lamp holder of FIG. 15.

Referring to FIGS. 15 and 16, a lamp holder is illustrated that is essentially a dual socket lamp holder where each socket is essentially the same as the socket shown in FIGS. 1–5. Components identical to those shown in FIGS. 1–5 bear the same reference numeral, while similar or related components are marked with a prime (′). Using this scheme, a receptacle 12′ is shown with a cavity 24′ whose base has a well 26′. Receptacle 12′ is one of a complementary pair, and its cohort-receptacle 12A′, is distinguished by the suffix "A". Using this latter scheme, receptacle 12A′ has formed therein a cavity 24A′ with a well 26A′.

As before, passageways 28′ and 28A′ proceed under cavities 24′ and 24A′ to communicate with wells 26′ and 26A′, respectively. Receptacles 12′ and 12A′ are integral with a flange 132. Flange 132 is designed to fit over a larger, metal junction box 134 (shown in phantom in FIG. 16). Flange 132 is secured to the junction box 134 with screws (not shown) fastened through screw holes 134 in the flange.

Two identical lamp contacts 30, identical to those previously shown in FIG. 1, are shown mounted in cavities 24′ and 24A′ in a similar fashion; that is, snapped into grooves on opposing walls of the cavities. Contacts 30 have flared tips 32 that snap into said grooves.

The floor of clip 30 extends outwardly into perforated tab 34, which is welded to block 36. Block 36 has a threaded hole, which is transverse to a wire channel with the previously illustrated flared mouth. Wire-securing screw 44 can be threaded through tab 34 to hold a wire in place inside block 36 as previously described in connection with FIG. 3. A high voltage wire will be routed through passageways 28′ and 28A′ to connect to the respective clips 30 in the manner previously described.

Referring to FIG. 17, a lamp holder is illustrated with two cavities 106″ and 106A″. Cavity 106″ is shaped the same as cavity 106′ of FIG. 14. Cavity 106″ is shown with a dividing wall 137 fitted into grooves (see grooves 130 of FIG. 14). Cavity 106A″ is the same as cavity 106″, except that it does not have either a dividing wall or a grooves for accepting a dividing wall. It will be a appreciated that in practical embodiments the two cavities would normally be identical, but different cavities are shown herein for demonstrative purposes.

Cavities 106″ and 106A″ are formed in a single dependent body 140, which has a flange 136 with screw holes 138 designed to attach the illustrated lamp holder to a standard (or non-standard) electrical junction box (not shown). As with the embodiment of FIG. 14, body 140 does not have any wire passageways communicating with the cavities 106″ and 106A″. Therefore, the cavities 106″ and 106A″ will each operate as jumper sockets to connect two lamps in series. Such an arrangement would be useful where lamps are routed in end-to-end, parallel pairs.

The lamp contact in cavity 106″ has a clip 114′ and 116′ joined together by a bridge 122′. This lamp contact is almost identical to that shown in FIG. 12, except that the bridge 122′ does not receive a wire-securing screw and does not attach to a block (screw 124 and block 126 of FIG. 12). As before, the flared tips 118′ and 120′ will snap into grooves in the sidewalls of cavity 106″. The lamp contact will be further secured in place in that the bridge 122′ will be trapped under dividing wall 137.

Lamp contact 94A′ is essentially identical to that shown in FIG. 11 (except that tab 98 of FIG. 11 is eliminated). As before, the flared tips 96A′ will snap into grooves in the sidewalls of cavity 106A″.

The lamp holder of FIG. 18 is identical to that shown in FIG. 4, except that the previously illustrated flange (flange 14) was eliminated and replaced with a surface mounting flange 140 having mounting holes 142. Corresponding components in FIG. 18 bear the same reference numerals but are marked with a double prime (″). In this embodiment the lamp holder is not designed to be attached to a junction box. Instead, the lamp holder can be separately mounted on a surface by means of flange 140 and mounting holes 142. It will be appreciated, however, that wire passageway 28″ is relatively long and therefore maintains a relatively large spacing for the high voltage components.

Referring to FIG. 19, the illustrated lamp holder is substantially the same as shown in FIG. 18, except that cavity 24‴ has been widened to make a substantially uniform wall thickness. Accordingly, components corresponding to that previously illustrated in FIG. 18 have the same reference numerals but are marked with a triple prime (‴). Again, this lamp holder is shown with a lower flange 140‴ to enable surface mounting. In alternate embodiments, the lamp holder may have an upper flange 142A‴ (shown in phantom), which will enable an installer to recess the lamp holder into a structure such as a wall. Again, wire passageway 28‴ is relatively long and therefore maintains a relatively large spacing for high voltage components.

Referring to FIG. 20, a lamp holder 144 is shown as a cup-shaped receptacle 146 having an integral lower flange 148 with several mounting holes 150 for facilitating surface mounting. In alternate embodiments, flange 148 may be repositioned above as an upper flange 152 (shown in phantom) for facilitating recess mounting. Receptacle 146 has an offcentered cavity 154 creating a relatively thick sidewall 156. A wire passageway 158 passes through relatively thick sidewall 156 to communicate from the outside into cavity 154. Unlike the foregoing embodiments, this passageway 158 does not pass underneath cavity 154. Nevertheless, passageway 158 is relatively long because sidewall 156 is relatively thick. Therefore a large spacing is maintained from the high voltage components inside cavity 154.

A lamp contact 30" mounted inside cavity 154 is similar to the contact of FIG. 1 (contact 30). Features of contact 30" corresponding to those of FIG. 1 have the same reference numeral, except for being marked with a double prime (″). Contact 30" is essentially the same as that shown in FIG. 1 except that tab 34" is longer and is bent into a Z shape. Again, contact 30" is held in place inside cavity 154 by being snapped into grooves 158 on opposite walls of cavity 154.

A wire-securing screw 160 is threaded into an aperture on the plateaued end of tab 34". Accordingly, a high voltage wire can be routed through passageway 158 and terminated at tab 34" by being fastened thereto by the securing screw 160.

Figure 22:
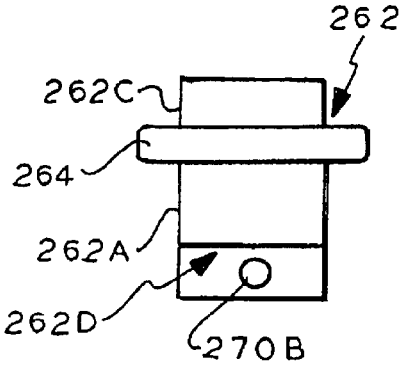
FIG. 22 is an elevational end view of the insulating body of FIG. 21.
Figure 21:
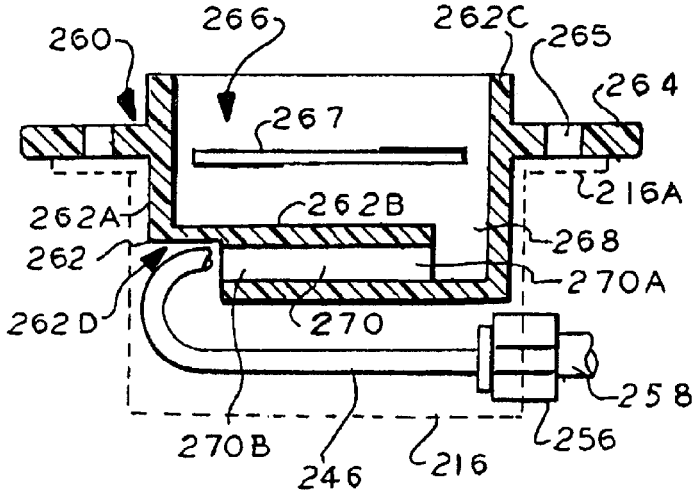
FIG. 21 is a sectional, elevational view of an insulating body for a lamp holder that is an alternate to that of FIG. 1.
Figure 23:
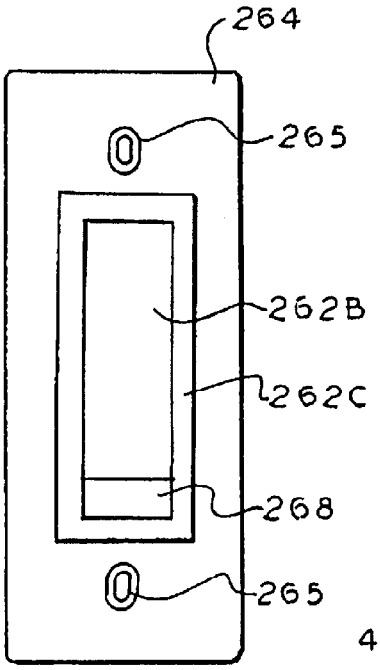
FIG. 23 is a top view of the insulating body of FIG. 21.

Referring to FIGS. 21–23, an alternate insulating body 260 having a cup-shaped receptacle 262 designed to receive two discharge lamps is encircled by a flange 264, which has fastening holes 265 and a generally rectangular outline (although the corners can be somewhat rounded in some embodiments). Fastening holes 265 have an elongated opening (e.g., oval or slot-shaped) to allow laterally adjustable mounting of the insulating body 260. Insulating body 260 has a cavity 266 bounded on the side by encompassing walls 262A and serving as a lamp socket. The open end of cavity 266 serves as a lamp entryway. The base 262A of cavity 266 has a rectangular recess or well 268. A longitudinally disposed wire passageway 270 extends from an exit portal 270A in well 268 to an entrance portal 270B on the outside of receptacle 262, traveling partly underneath cavity 266. By taking this path, passageway 270 is relatively long.

A pair of grooves 267 are formed on opposite walls inside cavity 266. Grooves 267 are designed to capture the flared tips of clips such as those shown in FIGS. 10 and 11. As before, high voltage wire can be routed through wire passageway 270 into well 268 and terminated on hardware similar to that described previously.

The underside of receptacle 262 is notched with a stepped undercut 262D. This undercut 262D allows the entrance portal 270B to be set back to provide additional clearance around the entrance portal. In particular, insulating body 260 may be mounted in a standard switch box 216 and screws may be inserted through fastening holes 265 and threaded into flanges 216A of box 216. Accordingly, high voltage wire 246 and may be supplied through conduit 258, which conduit may be secured with fitting 256 to the side of standard switch box 216 (box shown in phantom in FIG. 21).

In this arrangement wire 246 is routed underneath body 216 and turned in a loop before being inserted into entrance portal 270B. The radius of curvature of the final turn of wire 246 is less than suggested by FIG. 21 since the wire is typically shifted to one side so that it is ultimately turning not only in the plane of FIG. 21 but also in a plane perpendicular thereto.

Preferably, undercut 262D will set entrance portal 270B back about 1.5 cm, although other set back dimensions are contemplated, depending upon the wire size, box size, etc. Also, the setback provided by undercut 262D will be beneficial if the high voltage wire is supplied on the same side as the entrance portal 270B (i.e., on the side opposite to that illustrated in FIG. 21). In that instance undercut 262D provides clearance for the fitting 256 and also allows the high voltage wire to be looped under body 260 and returned by making a turn similar to that illustrated in FIG. 21 (see also the routing described below in FIG. 24).

In practical embodiments the depth of cavity 266 must be sufficient to securely hold the electrode end of a discharge lamp. In one preferred embodiment the cavity depth was about 3.8 cm, although other depths are contemplated. This depth plus the spacing needed to accommodate wire passageway 270 will affect the overall height of the insulating body 260. In one embodiment the overall height was 6.0 cm, although this height can vary depending upon the type of lamp, the desired support, etc. If body 260 was fully inserted into switch box 216 there would be little clearance to route a high voltage wire under the body 260. For this reason, cavity 266 is upwardly extended by a collar 262C, which may be considered an extension of the encompassing walls 262A. Essentially, flange 264 is then at an elevation lower than that described for other embodiments, effectively lifting body 260 partially out of the box 216. In one embodiment collar 262C was 1.3 cm tall, although this dimension can vary depending upon the clearance desired inside box 216.

Figure 24:
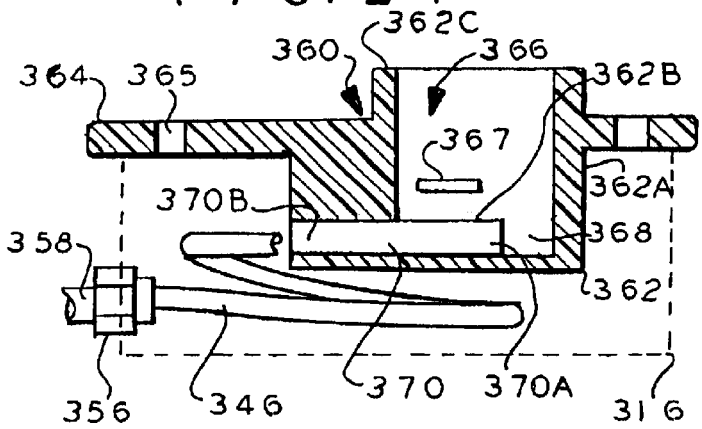
FIG. 24 is a sectional, elevational view of an insulating body for a lamp holder that is an alternate to that of FIG. 1.

Referring to FIG. 24, the insulating body 360 adopts the extended collar concept disclosed in FIG. 21. Elements in FIG. 24 that correspond to elements of FIG. 21 have the same reference numeral but incremented by 100. Thus, FIG. 24 shows a lamp receptacle cavity 366 bounded by encompassing walls 362A, which are extended by collar 362B. As before, flange 364 with its elongated fastening holes 365 encircles receptacle 362 at a location that provides additional clearance below base 362B. Also as before, cylindrical wire passageway 370 travels from entrance portal 370B to exit portal 370A, which is adjacent to terminal well 368. Grooves 367 are employed again to hold an electrode clip in place. The insulating body 360 of this embodiment is designed to receive a single lamp and offers essentially the same functions provided by the embodiment of FIG. 1.

The insulating body 360 is in this instance mounted in a utility box 316 that is larger than the box shown in FIG. 21. Here, conduit 358 is attached by fitting 356 on the side of utility box 316 facing entrance portal 370B. High voltage wire 346 is initially routed under body 360 and is formed into a loop that eventually turns back into entrance portal 370B of wire passageway 370. A separate undercut is not needed in this single lamp embodiment or clearance to enable the final turn of the high voltage wire. The foregoing routing does illustrate how such routing would be performed in the embodiment of FIG. 21 if the high voltage wire entered from the opposite side.

Figure 25:
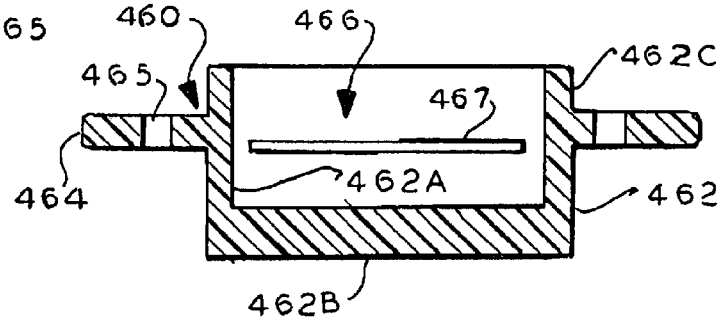
FIG. 25 is a sectional, elevational view of an insulating body for a lamp holder that is an alternate to that of FIG. 1.

Referring to FIG. 25, the insulating body 460 also adopts the extended collar concept disclosed in FIG. 21. Elements in FIG. 25 that correspond to elements of FIG. 21 have the same reference numeral but incremented by 200. Thus, an alternate lamp holder is shown as an insulating body 460 having a cup-shaped receptacle 462 encircled by a flange 464, which has elongated fastening holes 465 and a generally rectangular outline. Insulating body 460 has a cavity 466 serving as a lamp socket. Cavity 466 has an opening serving as a lamp entryway. Insulating body 460 does not have a wire entranceway since this embodiment serves as a jumper between two discharge lamps. A pair of grooves 467 are formed on opposite walls inside cavity 466 to hold electrode clips in place.

To facilitate an understanding of the principles associated with the foregoing apparatus, its operation will be briefly described in connection with the embodiment of FIGS. 1–5. Lamp contact 30 is installed inside cavity 24 as shown in FIG. 2. Thereafter, an electrical junction box 16 can be outfitted as shown in FIG. 1. Specifically, flexible conduit 58 is attached to one face 18 of box 16. High voltage wire 46 (for example, a GTO type wire) is connected at one end to a secondary of a high voltage transformer (not shown). The other end of wire 46 is routed through flexible conduit 58 into box 16.

The end of wire 46 is stripped and inserted into passageway 28. As shown in FIG. 3, the stripped end of wire 46 is inserted through the funnel-shaped mouth 40 into wire channel 38. Thereafter, screw 44 is tightened to clamp wire 46 inside channel 38. Next, flange 14 is placed atop box 16 and secured in place by threading screws 52 into the holes in landings 48.

A lamp holder similar to that just described will be installed at a nearby location at a distance depending upon the size of the lamp being serviced.

Alternatively, a jumper socket such as that shown in FIG. 14 may be installed so that a first lamp may be serially connected to a second lamp. In any event, a terminal socket will be required at the end of the series so that a return high voltage wire can be connected in a circuit.

Preferably, the lamp holders will be installed with a metal junction box 16 to provide a grounded structure surrounding the lamp holder to reduce the risk of uncontrolled or open high voltage arcing or corona. However, some embodiments will not employ a metal junction box and the flange 14 may be secured directly to a nearby structure or may be installed on supporting standoffs. Flange 14 may also be used for a recessed mounting. In some embodiments, a lamp holder may be mounted directly on a surface with a lower flange, such those shown in FIGS. 18–20.

A metal cap (not shown) on the end of a discharge lamp can now the inserted into the lamp contact 30. Contact 30 is a springy structure that will open to accept the discharge lamp and hold it firmly in place. Thereafter, the transformer can be powered to generate high voltage to light the discharge lamp.

Obviously, many modifications and variations of the present invention are possible in light of the above teachings. It is therefore to be understood that within the scope of the appended claims, the invention may be practiced otherwise than as specifically described.

What is claimed is:

1. A lamp holder for receiving a discharge lamp, comprising:

an electrically conductive box having a bottom, an opening opposite said bottom, and one or more sidewalls circumscribing said opening; and an insulating body sized to fit at least partially into said box, said insulating body having a flange sized to surmount and circumscribe the one or more sidewalls that circumscribe said opening, said insulating body having (a) a cavity with a lamp entryway with a base that extends past said flange to reach into said box, (b) a collar projecting beyond said flange for extending said cavity beyond said flange and outside said box, and (c) a wire passageway providing access into said cavity; and a lamp contact mounted in said cavity for electrically engaging said discharge lamp.

2. A lamp holder according to claim 1 wherein said flange has a fastening hole with an opening elongated to allow laterally adjustable mounting of said insulating body.

3. A lamp holder according to claim 1 wherein said flange surrounds said cavity.

4. A lamp holder according to claim 3 wherein said flange has two pairs of opposite parallel edges.

5. A lamp holder according to claim 4 wherein said box has a spaced pair of landings transverse to and integral with said one or more sidewalls, said landings each having a threaded hole, said flange having screw holes with a spacing matching that of said threaded holes in said landings.

6. A lamp holder according to claim 4 wherein said insulating body has a cup-shaped receptacle depending from said flange.

7. A lamp holder according to claim 6 wherein said cup-shaped receptacle is offcentered on said flange toward a predetermined side.

8. A lamp holder according to claim 1 wherein said wire passageway travels partly underneath said cavity.

9. A lamp holder according to claim 1 wherein said cavity has a well sized to receive and hold a portion of said lamp contact.

10. A lamp holder according to claim 9 wherein said wire passageway emerges inside said well.

11. A lamp holder according to claim 1 comprising:

a fitting attached to said box for providing a portal for routing wire into said box.

12. A lamp holder according to claim 1 wherein said cavity and said lamp contact is sized to receive two discharge lamps.

13. A lamp holder according to claim 1 wherein said insulating body has a base, and one or more encompassing walls emerging from said base to form an outside perimeter, said wire passageway traveling from an entrance portal accessible from outside said body to an exit portal feeding into said cavity, said entrance portal being set back from the perimeter of said encompassing walls to provide clearance at said entrance portal.

14. A lamp holder adapted to fit at least partially into a standard metal junction box having a bottom, an opening opposite said bottom, and one or more sidewalls circumscribing said opening, said lamp holder comprising:

an insulating body sized to fit at least partially into said box, said insulating body having a flange sized to surmount and circumscribe the one or more sidewalls that circumscribe said opening, said insulating body having (a) a cavity with a lamp entryway with a base that extends past said flange to reach into said box, (b) a collar projecting beyond said flange for extending said cavity beyond said flange and outside said box, (c) a wire passageway providing access into said cavity; and a lamp contact mounted in said cavity for electrically engaging said discharge lamp.

15. A lamp holder according to claim 14 wherein said flange has a fastening hole with an opening elongated to allow laterally adjustable mounting of said insulating body.

16. A lamp holder according to claim 14 wherein said flange surrounds said cavity.

17. A lamp holder according to claim 14 wherein said insulating body has a cup-shaped receptacle depending from said flange.

18. A lamp holder according to claim 17 wherein said cup-shaped receptacle is offcentered on said flange toward a predetermined side.

19. A lamp holder according to claim 14 wherein said wire passageway travels partly underneath said cavity.

20. A lamp holder according to claim 14 comprising:

a fitting attached to said box for providing a portal for routing wire into said box.

21. A lamp holder according to claim 14 wherein said insulating body has a base, and one or more encompassing walls emerging from said base to form an outside perimeter, said wire passageway traveling from an entrance portal accessible from outside said body to an exit portal feeding into said cavity, said entrance portal being set back from the perimeter of said encompassing walls to provide clearance at said entrance portal.

22. A lamp holder for receiving a discharge lamp, comprising:

an insulating body having a base, and one or more encompassing walls emerging from said base to form an outside perimeter and to circumscribe a cavity that is open through a lamp entryway, said insulating body having a wire passageway formed therein and partly traveling underneath said cavity from an entrance portal accessible from outside said body to an exit portal feeding into said cavity, said entrance portal being set back from the perimeter of said encompassing walls to provide clearance at said entrance portal; and a lamp contact mounted in said cavity for electrically engaging said discharge lamp.

23. A lamp holder according to claim 22 wherein said insulating body has a stepped undercut, said entrance portal opening into the stepped undercut.

24. A lamp holder according to claim 22 wherein said insulating body has a flange with a fastening hole having an opening elongated to allow laterally adjustable mounting of said insulating body.

25. A lamp holder according to claim 22 wherein said insulating body has a flange surrounding said cavity and a collar projecting beyond said flange for extending said cavity beyond said flange.

26. A lamp holder according to claim 22 wherein said insulating body has a flange with two pairs of opposite parallel edges.

27. A lamp holder according to claim 26 wherein said insulating body has a cup-shaped receptacle depending from said flange.

28. A lamp holder according to claim 27 wherein said cup-shaped receptacle is offcentered on said flange toward a predetermined side.

29. A lamp holder according to claim 22 wherein said wire passageway travels partly underneath said cavity.

30. A lamp holder for receiving a discharge lamp, comprising:

an electrically conductive box having a bottom, an opening opposite said bottom, and one or more sidewalls circumscribing said opening; and an insulating body sized to fit at least partially into said box, said insulating body having a flange sized to surmount and circumscribe the one or more sidewalls that circumscribe said opening, said insulating body having (a) a cavity with a lamp entryway with a base that extends past said flange to reach into said box and (b) a collar projecting beyond said flange for extending said cavity beyond said flange and outside said box; and a lamp contact mounted in said cavity for electrically engaging said discharge lamp.

* * * * *